United States Patent [19]

Nakanishi

[11] Patent Number: 4,635,610

[45] Date of Patent: Jan. 13, 1987

[54] HOT AIR CIRCULATING OVEN RANGE USING SHAPE MEMORY ALLOY

[75] Inventor: Takao Nakanishi, Takaichi, Japan

[73] Assignee: Sharp Kabushiki Kaisha, Osaka, Japan

[21] Appl. No.: 723,519

[22] Filed: Apr. 15, 1985

[51] Int. Cl.[4] ..... F24C 15/32

[52] U.S. Cl. ..... 126/21 A; 126/15 R; 126/15 A; 126/285 B; 219/10.55 B; 219/10.55 E; 219/400

[58] Field of Search ..... 219/10.55 R, 10.55 B, 219/10.55 E, 10.55 C, 400; 126/21 A, 21 R, 15 A, 15 R, 285 B

[56] References Cited

U.S. PATENT DOCUMENTS 4,308,444 12/1981 Takagi et al. ..... 219/400 X 4,450,344 5/1984 Sakoda et al. ..... 219/10.55 B X

*Primary Examiner*—Randall L. Green

*Attorney, Agent, or Firm*—Birch, Stewart, Kolasch & Birch

[57] ABSTRACT

A hot air circulating oven in which separate shape memory alloy springs are employed as a drive means to open and close a damper for the oven.

2 Claims, 3 Drawing Figures

HOT AIR CIRCULATING OVEN RANGE USING SHAPE MEMORY ALLOY

BACKGROUND OF THE INVENTION

The present invention concerns a hot air circulating oven range using shape memory alloy springs to drive the damper which changes over the airflow inside the oven.

Shape memory alloys try to return to their original shape when they reach a certain temperature, which enables the use of this material as a spring to drive the opening/closing of a damper depending on temperature.

However, with the normal type of shape memory alloy, the force with which the alloy trys to return to its original shape reduces the effective usage or length of use of the alloy, or in other words the alloy deteriorates, so that when a bias spring is used to keep a damper open, the force with which the shape alloy must pull against this spring to close the damper gradually reduces as it deteriorates, and eventually the force of the shape memory alloy is so small that it cannot overcome the force of the bias spring for closing the damper. This in turn results in a lower thermal efficiency when cooking with the hot air circulation method.

OBJECT AND SUMMARY OF THE INVENTION

Accordingly, the object of the present invention is to provide a device for definitely opening and closing the damper, even if the shaped memory alloy deteriorates to a certain extent, based on the above information.

In order to achieve the above objective according to the present invention, separate shape memory alloy springs are used for opening and closing of the damper.

DETAILED DESCRIPTION OF THE INVENTION

The embodiment of this invention will now be explained using the diagrams.

Figure 1:
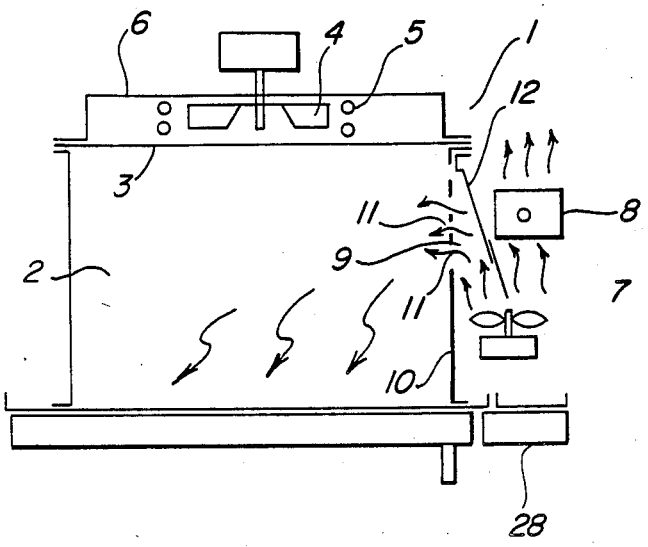
FIG. 1 is a side sectional view of an outline of an embodiment of the hot air circulating oven range of the present invention.
Figure 2:
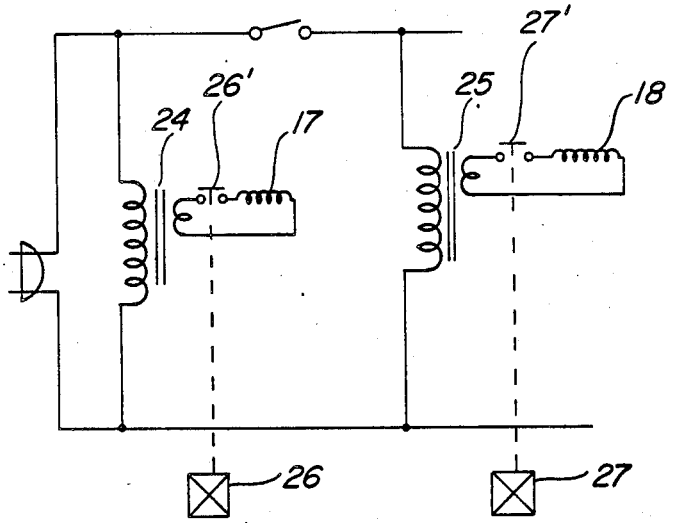
FIG. 2 is a circuit diagram of the major elements of the damper drive.

In FIG. 1, element 1 is a hot air circulating oven range which comprises a hot air circulating fan 4 and a heater 5 disposed near the fan. The fan and heater are incorporated into a hot air circulating duct 6 that is mounted to the back 3 of the oven 2. The cooling fan 7 cools the magnetron 8 which emits microwaves and supplies air to the inside of the oven 2 during microwave cooking.

Element 9 is an opening in the upper part of the side wall(s) 10 of the oven 2, and is provided with multiple small holes 11. A damper duct 12 is located near and above opening 9, and a damper cover 14 is mounted to the end of the damper duct and swivels on a rotating shaft 13. Element 15 defines a damper angle which allows the end of the damper cover 14 to rotate on the rotating shaft 16, and a damper drive plate 19 is mounted to the end of the damper cover 14 where it freely rotates. A shaped memory alloy spring 17 which is in a compressed state when the damper cover 14 is closed and a shape memory alloy spring 18 which is in a compressed state when the damper cover 14 is opened are mounted on the drive plate 19 at appropriate intervals in such a way as to allow for free rotation. Elements 20 and 21 are power source supply terminals for the above shape memory alloy springs 17, 18, which are fixed to the angle which is fixed to the back of the oven (not shown in diagram) by means of insulators. Elements 22 and 23 are lead wires which are connected to the above power supply terminals 20, 21, and which are connected to the AC power source which is set to a specified value by the power transformers 24 and 25. Elements 26 and 27 are relays which are operated by the respective operation of microwave heating or hot air circulation heating.

On the control panel 28 of the hot air circulating oven, 26', 27' are the contacts for those relays, which are respectively connected in between the secondary side of the above power transformers 24, 25, and the above lead wires 22, 23.

Figure 3:
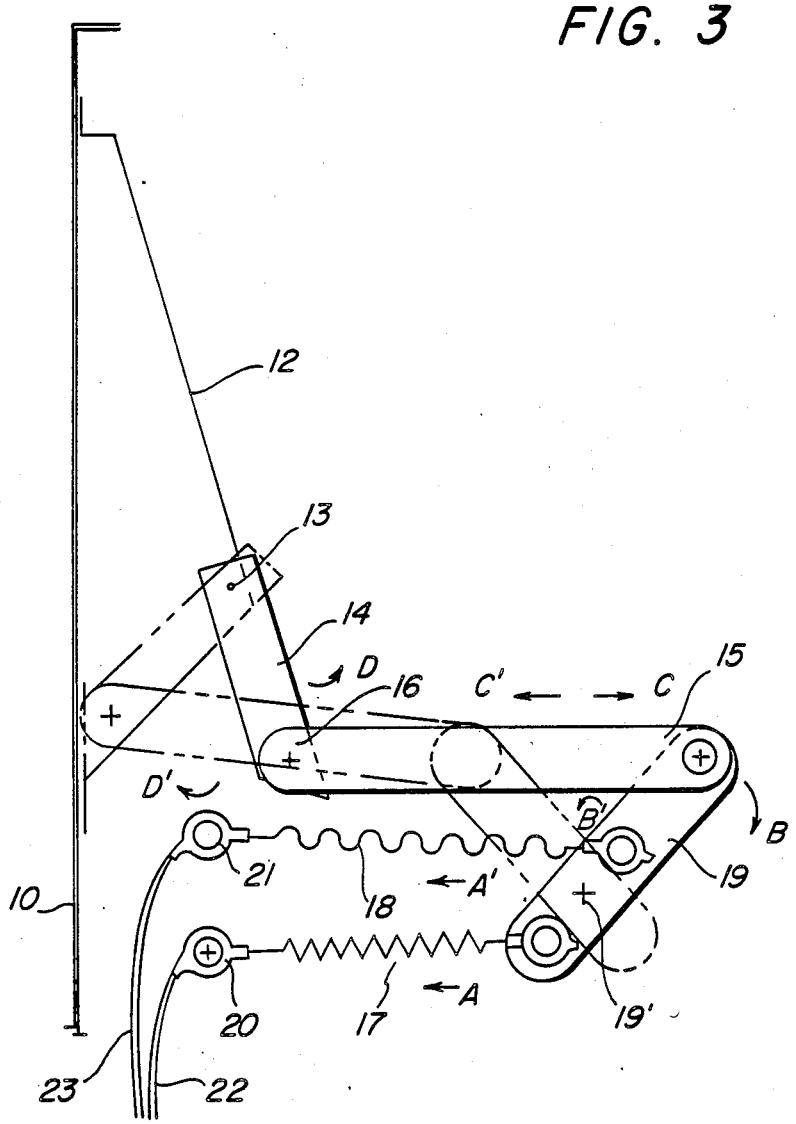
FIG. 3 is an enlarged explanatory diagram of an embodiment of the damper drive in the present invention.

Next, the embodiment of the present invention, which is composed of the components mentioned above, will be explained using FIG. 3, particularly the operation of the damper cover 14.

When the key on the control panel 28 is pressed, for example, microwave heating is initiated, and the cooling fan 7 operates at the same time as the magnetron starts oscillating. The relay contact 26' is closed when the relay 26 is energized, and the power transformer 24 supplies AC voltage, lowered to an appropriate value, to the shape memory alloy spring 17. Joule heat is generated to rapidly heat the shape memory alloy spring 17, causing the spring to exert a force to return to its original shape which it has memorized the spring contracts, as shown by arrow (A), causing the damper drive plate 19 to rotate in the direction indicated by arrow B around its rotation shaft 19'. Accordingly, damper angle 15 moves in the direction indicated by arrow C, and the damper cover 14 rotates in the direction indicated by arrow D. When the shape memory alloy spring 17 reaches a certain temperature due to the joule heat caused by the AC power supplied by the above lead wire 22, ( - - ) and ( - - - ) are respectively held at the positions indicated by the solid lines, and the damper cover 14 is opened. The air supplied by the cooling fan 7 is thus supplied through the opening 9 in the side wall 10 of the oven 2.

Next, when hot air circulation heating is effected, the relay 27 is energized at the same time as power is supplied to the hot air circulating fan 4 and heater 5 by operating the key on the above control panel 28. The relay contacts 27' are closed, causing the power transformer 25 to supply AC voltage, lowered to an appropriate value, to the shape memory alloy spring 18, joule heat is generated to heat the shape memory alloy spring 18, causing the spring to rapidly exert a force to return to the original shape which it has memorized as in the case of the previously mentioned shape memory alloy spring 17. The alloy spring 18 contracts as shown by arrow A', causing the damper drive plate 19 to rotate in the direction indicated by arrow B' around its rotational shaft 19'. The damper angle 15 moves in the direction indicated by arrow C', the damper cover 14 rotates in the direction indicated by arrow D', and they are respectively held at the positions indicated by the dotted line, causing the damper cover 14 to be closed. Accordingly, cooling air is no longer supplied to the oven 2, and the air that has been heated with the heater 5 is forced into the oven by the hot air circulating fan 4, improving heating efficiency due to circulation in the oven 2, for efficient cooking of food in the oven 2.

Furthermore, since power is not supplied to the previously mentioned shape memory alloy spring 17, the force keeping the damper cover 14 closed is only the elasticity of the above shape memory alloy spring 18.

In the opening and closing of the damper cover 14 according to the present invention, a shape memory alloy spring 17 for opening, and a shape memory alloy spring 18 for closing have respective direct power sources to generate joule heat used to cause the springs to remember their original shape, providing for positive opening and closing of the damper, and ensuring that the shape memory alloys can be used to drive the damper even if they deteriorate to a certain extent, as long as they maintain their shape memory function thus, longer life of the damper opening/closing device is provided, and, in turn, a more reliable hot air circulating oven.

What is claimed is:

1. In a hot air circulating-microwave oven comprising an oven chamber provided with an aperture, damper means operative to open and close said aperture, and fan means operatively associated with said aperture for supplying air through said aperture to the inside of the oven during microwave cooking, the improvement which comprises, first and second opposite-acting memory shaped alloy springs connected to said damper means, and electrical current means connected to said first and second springs for energizing one of said springs to open said damper to introduce air into the oven chamber, and the other of said springs to close said damper, said first and second shaped memory alloy springs not being energized at the same time.

2. The hot air circulating-microwave oven of claim 1, wherein one of said springs is in a compressed state when the damper is closed and the other of said springs is in a compressed state when the damper is open.

* * * * *